US007182319B2

(12) United States Patent
Panzarella et al.

(10) Patent No.: US 7,182,319 B2
(45) Date of Patent: Feb. 27, 2007

(54) ROLLER ASSEMBLY FOR A LIFTING DEVICE FOR A PERSONAL-TRANSPORTATION VEHICLE

(75) Inventors: Thomas A. Panzarella, Harleysville, PA (US); James B. Eldon, III, Barto, PA (US); David D. McClanahan, Harleysville, PA (US)

(73) Assignee: Cook Technologies, Inc.

( * ) Notice: Subject to any disclaimer, the term of this patent is extended or adjusted under 35 U.S.C. 154(b) by 143 days.

(21) Appl. No.: 10/873,350

(22) Filed: Jun. 21, 2004

(65) Prior Publication Data

US 2005/0035338 A1 Feb. 17, 2005

Related U.S. Application Data

(60) Provisional application No. 60/479,681, filed on Jun. 19, 2003.

(51) Int. Cl.
*B66D 3/04* (2006.01)

(52) U.S. Cl. ..... 254/390

(58) Field of Classification Search ..... 242/230–232; 384/417; 254/390, 393, 404, 901
See application file for complete search history.

(56) References Cited

U.S. PATENT DOCUMENTS

| | | | | |
|---|---|---|---|---|
| 1,819,334 A | * | 8/1931 | North | 474/183 |
| 1,857,434 A | * | 5/1932 | Cole | 254/390 |
| 3,711,877 A | | 1/1973 | Averill | 5/81 |
| 3,804,350 A | * | 4/1974 | Williams | 242/157.1 |
| 4,057,025 A | * | 11/1977 | Piotrowski | 114/210 |
| 4,111,316 A | | 9/1978 | Wappler | 414/550 |
| 4,419,038 A | | 12/1983 | Pendergraft | 414/543 |
| 4,441,304 A | * | 4/1984 | Douwenga | 53/568 |
| 4,463,858 A | | 8/1984 | Bilas | 212/176 |
| 4,562,976 A | * | 1/1986 | Ban | 242/231 |
| 4,991,810 A | | 2/1991 | Andrus et al. | 248/286.1 |
| 5,090,580 A | | 2/1992 | Nelson | 414/467 |
| 5,156,517 A | | 10/1992 | Boissonneault | 414/467 |
| 5,195,726 A | | 3/1993 | Kaner | 254/325 |
| 5,431,526 A | | 7/1995 | Peterson et al. | 414/543 |

(Continued)

FOREIGN PATENT DOCUMENTS

EP 0 425 733 A1 5/1991

OTHER PUBLICATIONS

U.S. Appl. No. 10/830,252, filed Apr. 22, 2004, Panzarella et al.

(Continued)

*Primary Examiner*—Emmanuel M Marcelo
(74) *Attorney, Agent, or Firm*—Woodcock Washburn LLP

(57) ABSTRACT

A preferred embodiment of a roller assembly for a lifting device for a personal-transportation vehicle includes a shaft member for mounting on a lifting arm assembly of the lifting device and having an outer surface, and a roller member for supporting a lifting strap of the lifting device. The roller member has an inner surface defining a central passage for receiving the shaft and contacting the outer surface. The inner and outer surfaces have complementary profiles that permit a relative orientation of the roller member and the shaft member to change so that a weight vector acting through the lifting strap can remain substantially perpendicular to an axial centerline of the roller member.

30 Claims, 15 Drawing Sheets

U.S. PATENT DOCUMENTS

| | | | | | |
|---|---|---|---|---|---|
| 5,462,368 | A | * | 10/1995 | Lob | 384/512 |
| 5,667,464 | A | * | 9/1997 | Simonson | 482/97 |
| 5,752,799 | A | | 5/1998 | Carey et al. | 414/543 |
| 5,806,686 | A | * | 9/1998 | Ecker | 209/615 |
| 5,839,681 | A | * | 11/1998 | Kaneko | 242/231 |
| 5,944,274 | A | * | 8/1999 | Kaneko | 242/231 |
| 6,065,557 | A | * | 5/2000 | von Keyserling | 180/221 |
| 6,202,868 | B1 | | 3/2001 | Murray | 212/294 |
| 6,340,271 | B1 | * | 1/2002 | Carlson et al. | 405/184.4 |
| 6,460,908 | B1 | | 10/2002 | Green | 293/117 |
| 6,499,610 | B2 | | 12/2002 | Spitsbergen | 212/179 |
| 6,547,507 | B1 | | 4/2003 | Gest et al. | 414/543 |
| 2002/0074305 | A1 | | 6/2002 | Davis et al. | 212/180 |

OTHER PUBLICATIONS

Manual: Bruno Curb-Sider®, Bruno Model SL-600, Bruno Independent Living Aids, Inc. 1999, 2 pages.

Manual: Bruno Curb-Sider® Super XL, Bruno Model VSL-670, Bruno Independent Living Aids, Inc. 1999, 2 pages.

Installation Manual: VSL-600 Curb Sider® and VSL-670 Curb Sider SXL®, Bruno Independent Living Aids, Dec. 6, 1999, 36 pages.

Operators Manual: VSL-600 Curb Sider® and VSL-670 Curb Sider SXL®, Bruno Independent Living Aids, Oct. 19, 1999, 40 pages.

Trade Manual: HomeCareXtra Rehab/Mobility Focus, vol. III, Issue 3, 1999, 32 pages.

* cited by examiner

ROLLER ASSEMBLY FOR A LIFTING DEVICE FOR A PERSONAL-TRANSPORTATION VEHICLE

CROSS-REFERENCE TO RELATED APPLICATION

This application is based on provisional application No. 60/479,681 filed Jun. 19, 2003, the entirety of which is incorporated herein by reference.

FIELD OF THE INVENTION

The present invention relates generally to devices for lifting personal-transportation vehicles such as a power chairs. More specifically, the invention relates to a roller assembly for supporting a lifting strap of a lifting device.

BACKGROUND OF THE INVENTION

Personal-transportation vehicles such as power chairs, motorized wheelchairs, and scooters are commonly used by persons with ambulatory difficulties or other disabilities. Personal-transportation vehicles are often transported using a larger motorized vehicle such as a van, pickup truck, passenger car, etc. (hereinafter referred to as a "transporting vehicle").

Lifting devices have been developed for lifting personal transportation-vehicles onto and off of transporting vehicles. Some types of lifting devices include a lifting strap having a lifting hook attached to an end thereof. The lifting hook can engage a suitable lifting point on the personal-transportation vehicle. The lifting strap can be routed through and supported by a lifting arm of the lifting device. The lifting arm often includes a pin for suspending the lifting strap as the lifting strap exits the lifting arm assembly. The lifting strap can be retracted into and extended from the lifting arm assembly by a motor or other suitable means. Retraction and extension of the lifting strap raises and lowers the personal-transportation vehicle.

Lifting devices are often operated while the transporting vehicle is parked on a rough or uneven surface. Operating a lifting device under these conditions can cause the lifting strap to fold or "bunch up" as it passes over the pin of the lifting arm assembly. The lifting strap can also separate or otherwise become off-centered with respect to the pin, thereby raising the possibility for the lifting strap to rub against adjacent stationary structure of the lifting arm. Folding, bunching up, and rubbing of the lifting strap can cause the lifting strap to become frayed, torn, or worn, thereby increasing the potential for a catastrophic failure the lifting strap.

SUMMARY OF THE INVENTION

A preferred embodiment of a roller assembly for supporting a lifting device for a personal-transportation vehicle comprises a shaft member for mounting on a lifting arm assembly of the lifting device, and a roller member mounted on the shaft member and having an outer surface for contacting the lifting strap. At least a portion of the outer surface has a substantially concave shape in relation to an axial centerline of the roller member.

A preferred embodiment of a roller assembly for a lifting device for a personal-transportation vehicle comprises a shaft member for mounting on a lifting arm assembly of the lifting device and having an outer surface, and a roller member for supporting a lifting strap of the lifting device. The roller member has an inner surface defining a central passage for receiving the shaft and contacting the outer surface. The inner and outer surfaces have complementary profiles that permit a relative orientation of the roller member and the shaft member to change so that a weight vector acting through the lifting strap can remain substantially perpendicular to an axial centerline of the roller member.

Another preferred embodiment of a roller assembly for a lifting device for a personal-transportation vehicle comprises a shaft member for mounting on a lifting arm assembly of the lifting device. The shaft member has an outer surface having including a middle portion and an adjoining first and second end portion. The first and second end portions are curved so that the first and second end portions extend away from an axial centerline of the shaft member.

The roller assembly also comprises a roller member mounted on the shaft member and having an inner surface defining a central passage for receiving the shaft member and contacting the outer surface. The inner surface includes a middle portion and an adjoining first and second end portion. The first end portion of the inner surface has a radius of curvature substantially equal to a radius of curvature of the first end portion of the outer surface, and the second end portion of the inner surface has a radius of curvature substantially equal to a radius of curvature of the second end portion of the outer surface.

Another preferred embodiment of a roller assembly for supporting a lifting strap of a lifting device for a personal-transportation vehicle comprises a shaft member for mounting on a lifting arm assembly of the lifting device, and a roller member mounted on the shaft member. The roller member has an outer surface including a first and a second end portion, a first and a second intermediate portion that adjoin the respective first and second end portions and extend substantially perpendicular to an axial centerline of the roller member, and a middle portion that adjoins the first and second intermediate portions for contacting the lifting strap.

Another preferred embodiment of a roller assembly for a lifting device for a personal-transportation vehicle comprises a gimbal mechanism comprising an inner cylinder fixedly coupled to a lifting arm assembly of the lifting device, and an outer cylinder rotatably coupled to the inner cylinder. The roller assembly also comprises a shaft member extending through the outer cylinder and being secured to the outer cylinder so that the shaft member is restrained from substantial axial movement in relation to the outer cylinder, and a roller member rotatably coupled to the shaft member for supporting a lifting strap of the lifting device.

BRIEF DESCRIPTION OF THE DRAWINGS

The following detailed description of a preferred embodiment is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

A preferred embodiment of a roller assembly 10 for a lifting device for a personal-transportation vehicle is shown in FIGS. 1–10. The figures are referenced to a common coordinate system 11 depicted therein. The roller assembly 10 can be used as part of a lifting device 100 shown in FIG. 1. The lifting device 100 is described in detail in U.S. provisional application Ser. No. 60/464,931, which is hereby incorporated by reference herein in its entirety.

Figure 11:
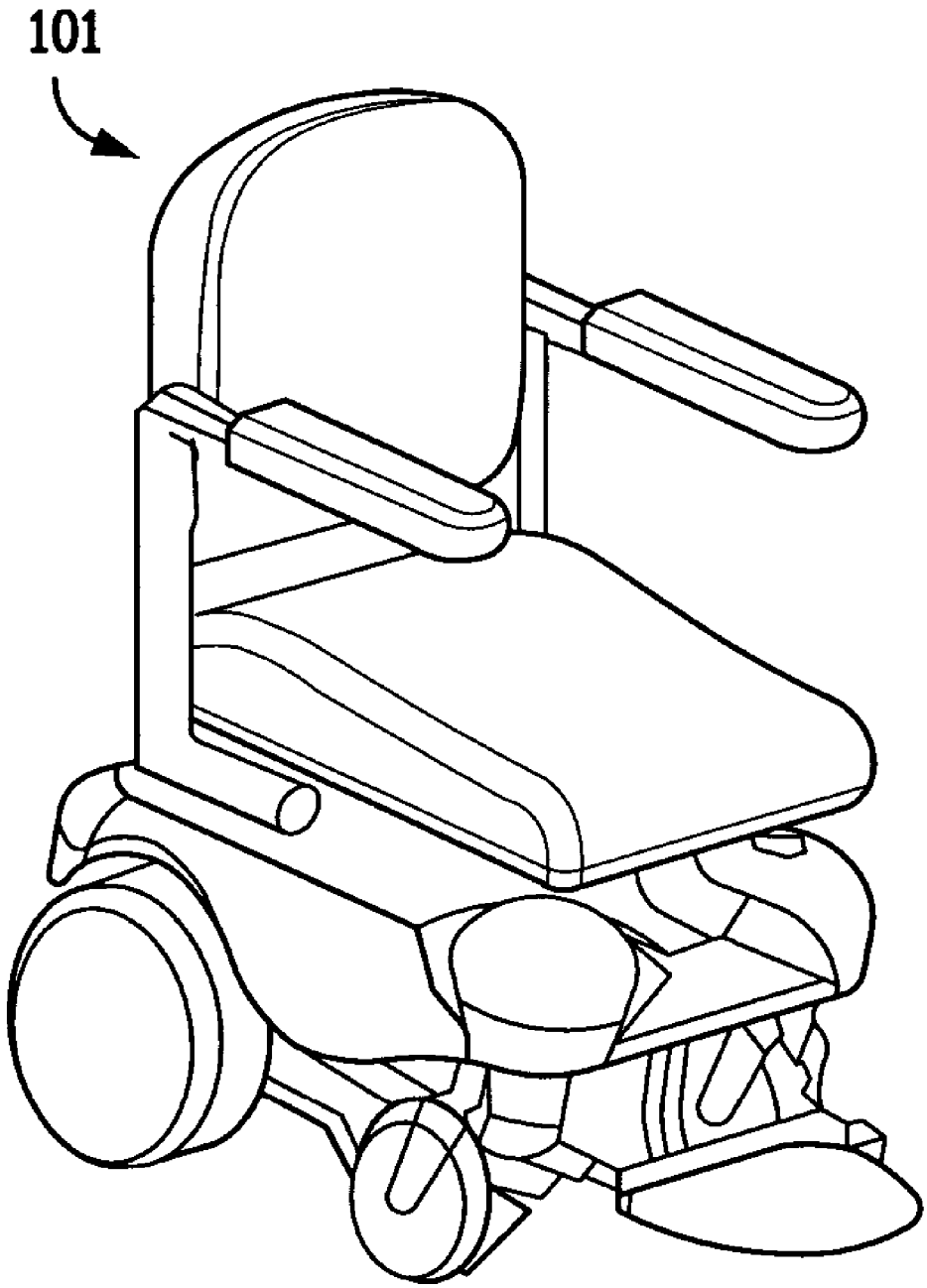
FIG. 11 is a perspective view of a power chair suitable for use with the lifting device and the roller assembly shown in FIGS. 1–10.

The lifting device 100 can be used in conjunction with a personal-transportation vehicle, such as a power chair 101 shown in FIG. 11. More particularly, the lifting device 100 can be used to lift the power chair 101 into and out of a larger vehicle (not shown), such as a van, pickup truck, or automobile, so that the power chair 101 can be transported from one location to another. (The vehicle used to transport the power chair 101 is hereinafter referred to as "the transporting vehicle.")

Figure 1:
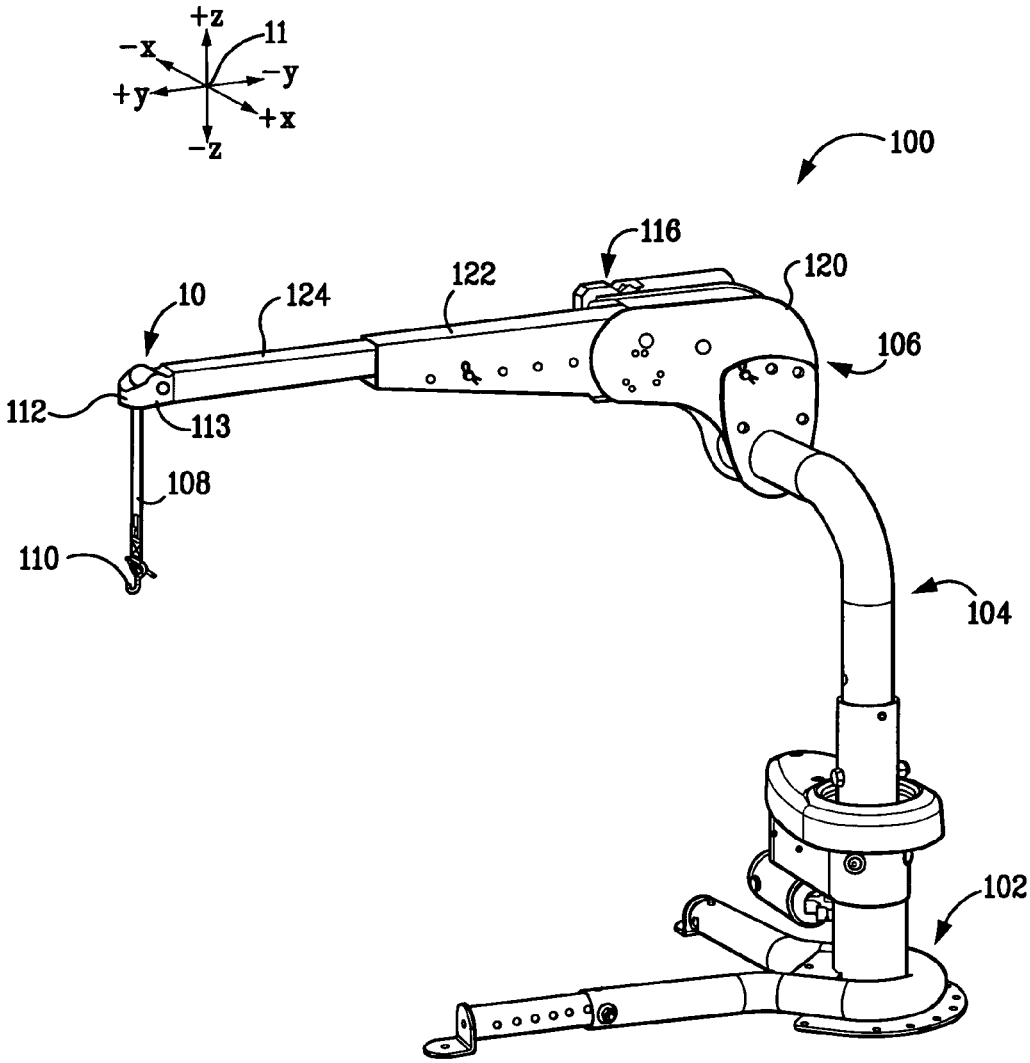
FIG. 1 is a perspective view of a lifting device for a personal-transportation vehicle, and a preferred embodiment of a roller assembly installed on the lifting device.
Figure 2:
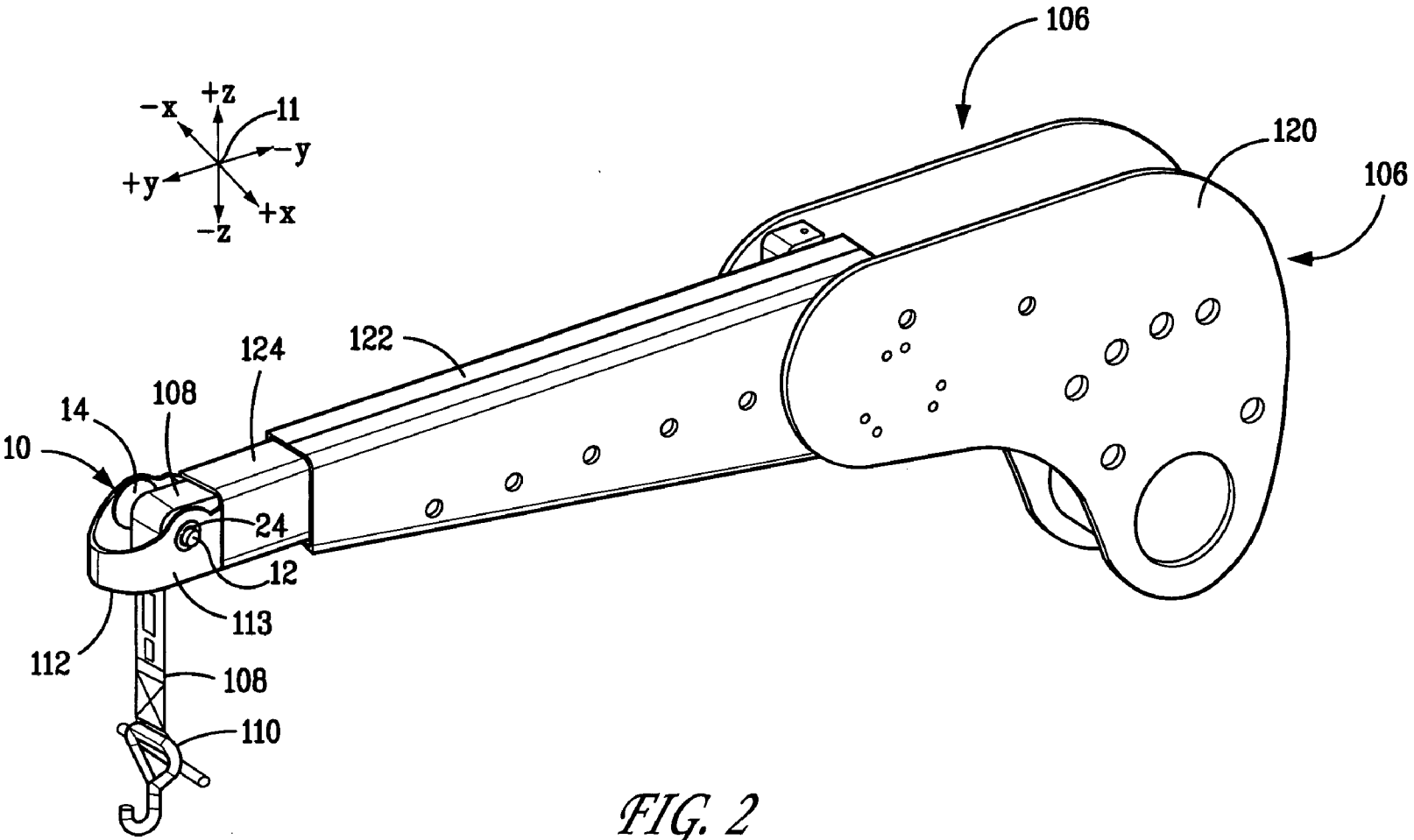
FIG. 2 is a perspective view of the roller assembly shown in FIG. 1, and a lifting arm assembly of the lifting device shown in FIG. 1.
Figure 3:
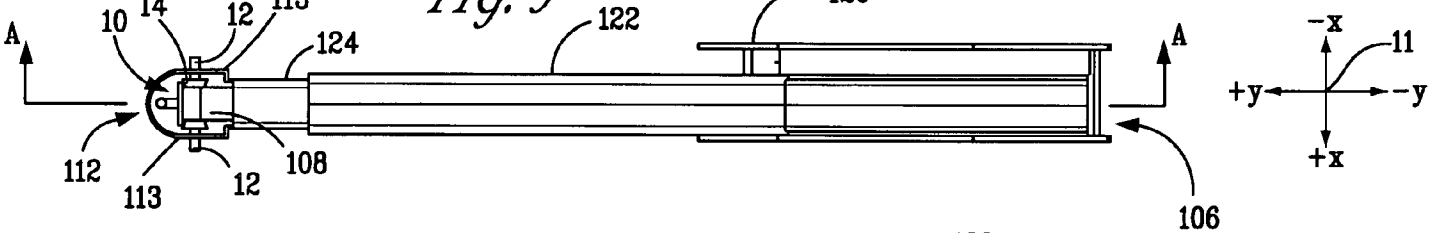
FIG. 3 is a top view of the roller assembly and lifting arm assembly shown in FIGS. 1 and 2.
Figure 4:
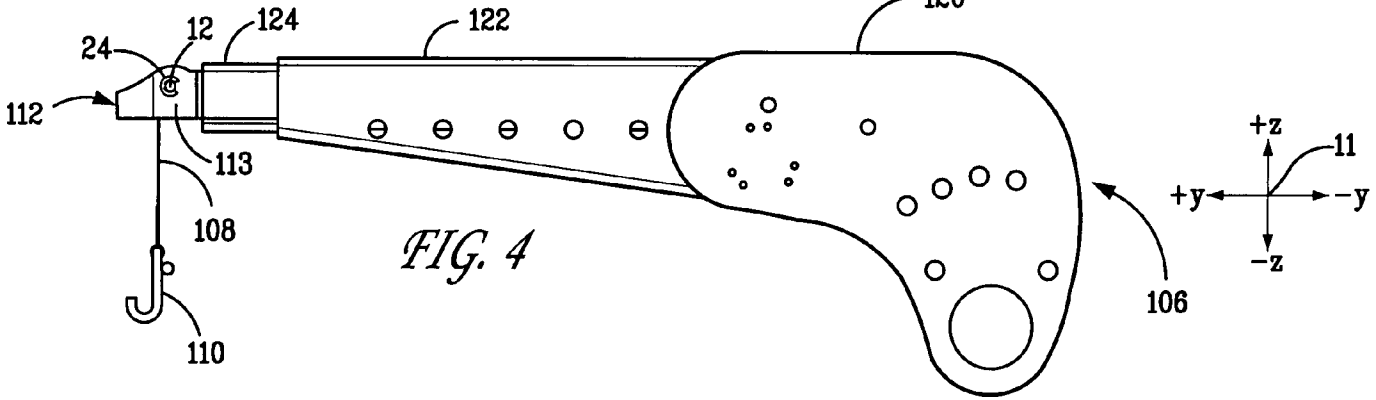
FIG. 4 is a side view of the roller assembly and lifting arm assembly shown in FIGS. 1–3.
Figure 5:
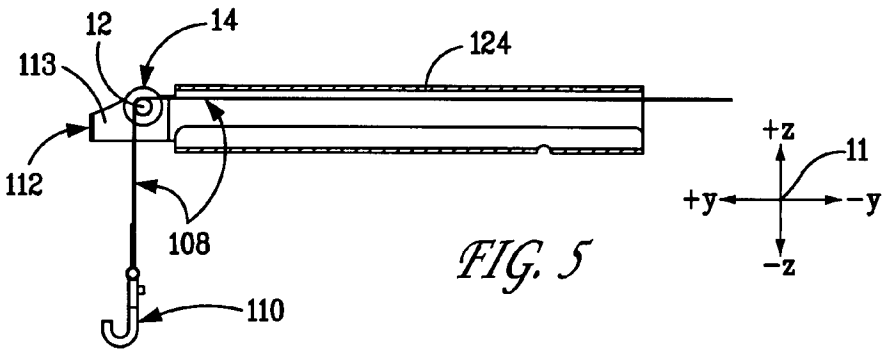
FIG. 5 is a cross-sectional side view of the roller assembly and lifting arm assembly shown in FIGS. 1–4, taken through the line "A—A" of FIG. 3.
Figure 6:
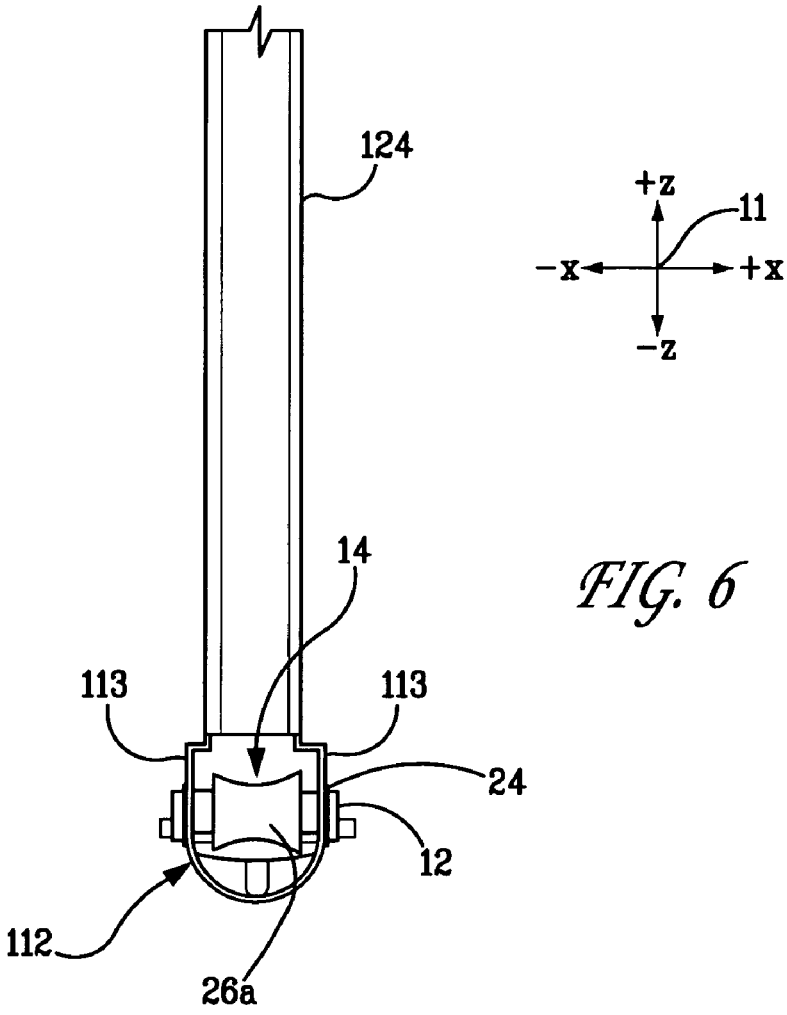
FIG. 6 is a top view of the roller assembly shown in FIGS. 1–5, and a boom portion of the lifting arm assembly shown in FIGS. 1–5, with a lifting belt of the lifting device removed for clarity.
Figure 10:
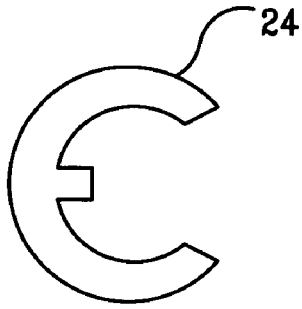
FIG. 10 is a side view of an E-ring of the roller assembly shown in FIGS. 1–10.

The lifting device 100 comprises a base assembly 102, a mounting column assembly 104, and a lifting arm assembly 106 (see FIG. 1). The lifting arm assembly 106 is mounted on the mounting column assembly 104. The mounting column assembly 104, in turn, is mounted on the base assembly 102. The base assembly 102 can be used to mount the lifting device 10 on a suitable surface of the transporting vehicle.

The lifting arm assembly 106 comprises a mounting portion 120, an arm portion 122 fixedly coupled to the mounting portion 120, and a boom portion 124 telescopically mounted in the arm portion 122 (see FIGS. 1–6). The lifting arm assembly 106 can be used to lift the power chair 101 onto or off of the transporting vehicle using a lifting strap 108, and a lifting hook 110 that engages a suitable lifting point on the power chair 101. The lifting strap 108 can be retracted into and extended from the boom portion 124 by a drive assembly 116 (see FIG. 1; the drive assembly 116 is depicted only in FIG. 1, for clarity).

The boom portion of the lifting arm assembly 106 includes a hood 112. The roller assembly 10 is mounted on the hood 112 and, as explained below, supports and guides the lifting strap 108 as the lifting strap 108 is retracted into and extended from the boom portion 112.

It should be noted that the roller assembly 10 is described herein in conjunction with the lifting device 100 and the power chair 101 for exemplary purposes only. The roller assembly 10 can be used as part of virtually any type of lifting device that incorporates a lifting strap or similar lifting means. Moreover, the roller assembly 10 can be used in conjunction with virtually any type of personal-transportation vehicle, including motorized scooters, wheelchairs, etc.

Figure 7:
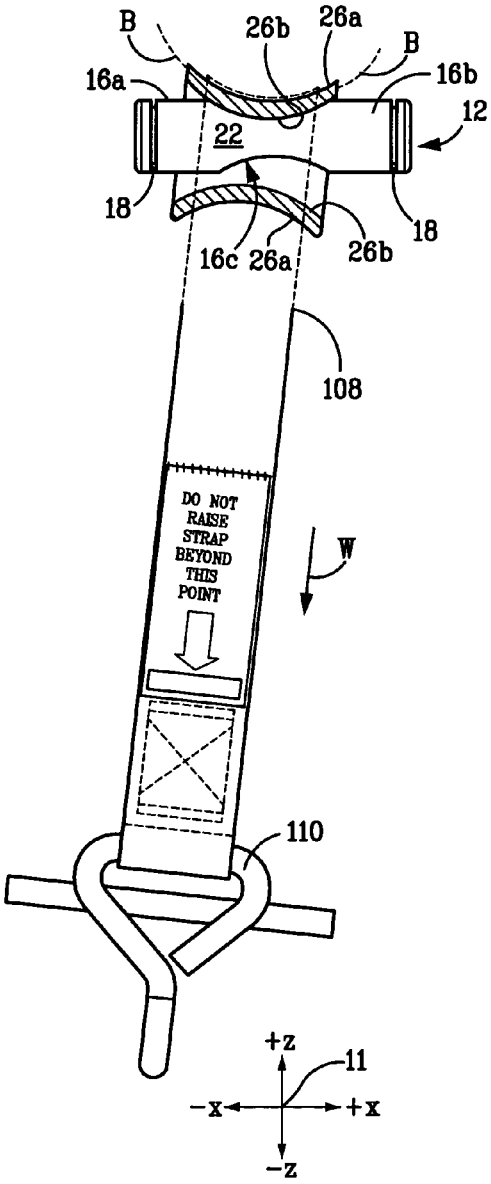
FIG. 7 is a front view of the roller assembly shown in FIGS. 1–6, and a lifting strap and a lifting hook of the lifting device shown in FIG. 1, showing a roller member of the roller assembly in longitudinal cross section, with a weight vector acting on the lifting strap in a direction that is not substantially perpendicular to an axial centerline of a shaft member of the roller assembly.
Figure 8:
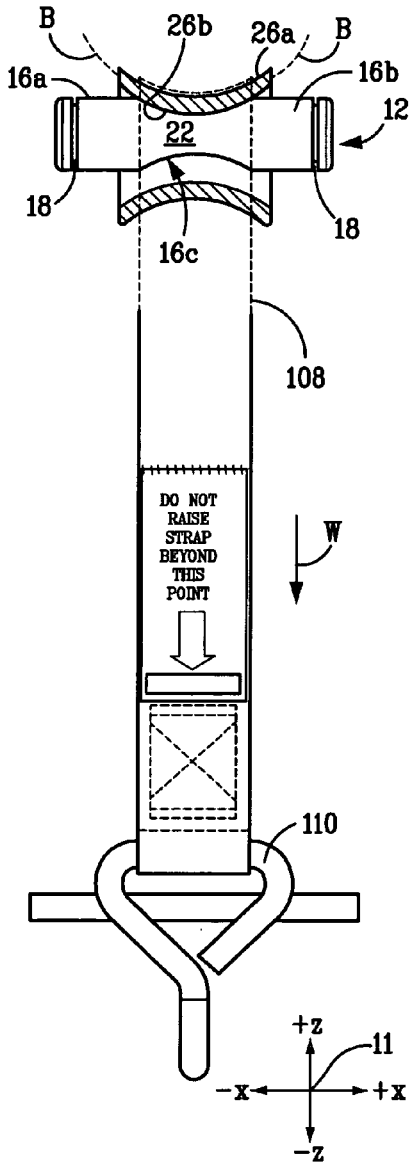
FIG. 8 is a cross-sectional front view of the roller assembly, the lifting strap, and the lifting hook shown in FIGS. 1–7, showing the roller member in longitudinal cross section, with the weight vector acting on the lifting strap in a direction that is substantially perpendicular to the axial centerline of the shaft member.
Figure 9:
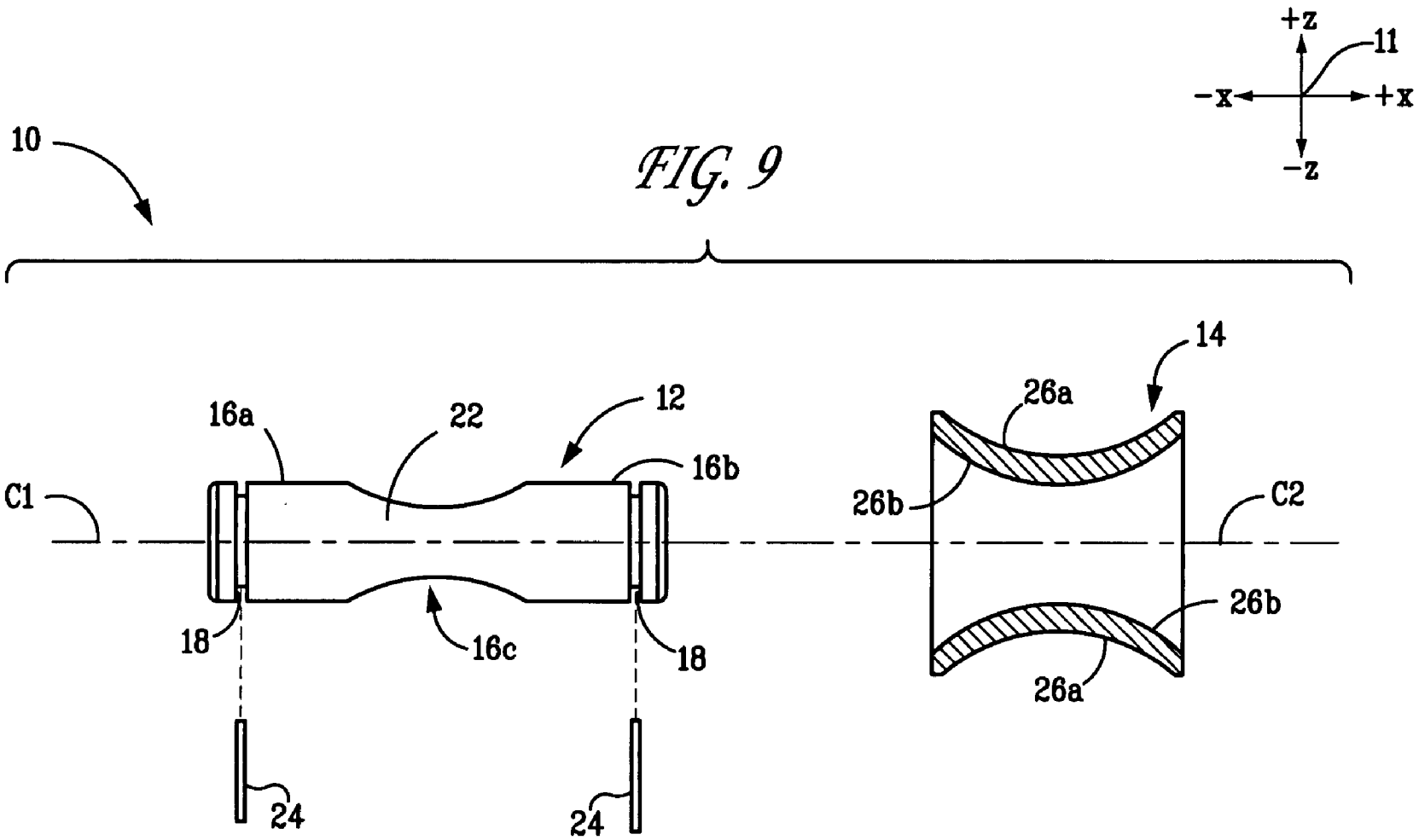
FIG. 9 is a front, exploded view of the roller assembly shown in FIGS. 1–8, showing a roller member of the roller assembly in longitudinal cross section.

The roller assembly 10 comprises a shaft member 12 and a roller member 14 (see FIGS. 7–9). The shaft member 12 has a first end portion 16*a*, a second end portion 16*b*, and a middle portion 16*c* that adjoins the first and second end portions 16*a*, 16*b*. The first and second end portions 16*a*, 16*b* each have a groove 18 formed therein. The middle portion 16*c* has a circumferentially-extending outer surface 22. The outer surface 22 has a substantially concave shape in relation to an axial centerline "C1" of the shaft member 12 (see FIG. 9). (The optimal radius of curvature for the outer surface 22 is application dependent. A specific value for this parameter therefore is not specified herein.)

The shaft member 12 is mechanically coupled to the hood 112, as shown in FIGS. 1–6. In particular, the hood 112 has a first and a second sidewall 113. The first and second sidewalls 113 each have a hole formed therein for receiving the shaft member 12. The shaft member 12 is sized so that the grooves 18 formed in the first and second end portions 16*a*, 16*b* are each located outward of an associated one of the sidewalls 113.

A conventional E-ring 24 or other suitable type of clip is inserted in each of the grooves 18. The E-rings 24 securely grasp the shaft member 12, and restrain the shaft member 12 from substantial movement in the axial ("x") direction in relation to the hood 112 (see FIGS. 2 and 4). The shaft member 12 is restrained from substantial movement in the vertical ("z") and lateral ("y") directions by the surrounding structure of the hood 112.

The roller member 14 has outer surface 26*a* and an inner surface 26*b* (see FIG. 9). The inner surface 26*b* defines a central passage 28 extending through the roller member 14. The outer and inner surfaces 26*a*, 26*b* each have a substantially concave shape in relation to a longitudinal axis "C2" of the roller member 14.

The central passage 28 has a diameter sufficient to permit the shaft member 12 to be positioned therein. In, other words, the minimum diameter of the inner surface 26*b* of the roller member 14 is greater than the maximum diameter of the shaft member 12.

The roller member 14 is positioned between the sidewalls 113 of the hood 112, and around the shaft member 12 when the roller assembly 10 is installed on the lifting device 100 (see FIGS. 3–8). Preferably, the curvature of the inner surface 26*b* of the roller member 14 is substantially equal to that of the outer surface 22 of the shaft member 12. This feature permits the inner surface 26*b* to rest on, and conform to the outer surface 22, as shown in FIGS. 7 and 8.

The lifting strap 108 is mechanically coupled to the power chair 101 by way of the lifting hook 110, as noted previously. The lifting strap 108 is supported from the roller assembly 10 (see, e.g., FIGS. 2, 5, 7, and 8). More particularly, the lifting strap 108 extends from the boom portion 124 of the lifting arm assembly 106, and wraps around a portion of the outer surface 26*a* of the roller member 14. The lifting strap 108 extends from the roller member 14 in a downward ("−z") direction (toward the ground) under normal operating conditions, due to the weight of the power chair 101. (The weight of the power chair 101 is represented by the vector designated "W" in FIGS. 7 and 8. The power chair 101 is not shown suspended from the strap 108, for clarity.)

The roller member can 14 can rotate in relation to the shaft member 12, about the axial centerline C1 thereof, as the lifting strap 108 is retracted into and extended from the boom portion 124. Rotation of the roller member 14 occurs in response to the weight vector "W" acting on the lifting strap 108, and friction between the lifting strap 108 and the outer surface 26*a* of the roller member 14.

The roller member 14 resides in a substantially level orientation in relation to the shaft member 12, i.e., the centerlines C1 and C2 are substantially parallel, when the weight vector "W" acts in a direction substantially perpendicular to the axial centerline C1 of the shaft member 12 (see FIG. 8).

More specifically, the complementary concave shapes of the inner surface 26*b* and the outer surface 22 permit a top portion of the roller member 14 to translate along an arc denoted by the reference character "B" in FIGS. 7 and 8. (The ends of the roller member 14 are preferably spaced apart from the sidewalls 113 of the hood 112 by a distance sufficient to permit the top portion of the roller member 14 to translate approximately fifteen degrees to either side of the "level" position depicted in FIG. 8).

The concave shapes of the inner surface 26*b* and the outer surface 22, in conjunction with the frictional force acting between the lifting strap 108 and the outer surface 26*a* in response to the weight vector "W," tend to center and level the roller member 14 in relation to the shaft member 12 when the weight vector "W" acts in a direction substantially perpendicular to the centerline C1 of the shaft member 12. (The weight vector "W" normally acts in a direction substantially perpendicular to the centerline C1 when the power chair 101 is lifted and lowered while the transporting vehicle parked on a level surface.)

The top portion of the roller member 14 can translate along the arc "B" when the weight "W" is not substantially perpendicular to the centerlines C1 and C2 of the respective shaft member 12 and roller member 14. In particular, the weight "W," in conjunction with the friction between the lifting strap 108 and the outer surface 26*a* of the roller member 14, causes the lifting strap 108 to exert a force component on the roller member 14 in the axial ("x") direction under these conditions. The axial force component, in conjunction with the concave shapes of the inner surface 26*b* and the outer surface 22, cause the top portion of the roller member 14 to move along the arc "B" until the axial force component approaches zero. (The axial force component approaches zero when the centerline C2 of the roller member 14 is substantially perpendicular to the weight vector "W.") Notably, the portion of the lifting strap 108 that extends from the roller member 14 is substantially aligned with the weight vector "W," as shown in FIG. 7, when the axial force component is at or near zero.

The lifting strap 108 can subsequently be retracted or extended. Retracting and extending the lifting strap 108 while the lifting strap 108 is substantially aligned with the weight vector "W" can substantially reduce the potential for the lifting strap 108 to fold, "bunch up," or separate from the roller member 14, or to otherwise become off-centered with respect to the roller member 14.

Retracting or extending a lifting strap, such as the lifting strap 108, while the lifting strap 108 is folded, "bunched up," separated, or otherwise off-centered with respect to the roller member 14 can cause the lifting strap 108 to become frayed, torn, or prematurely worn. For example, operating the lifting strap 108 while all or a portion of the lifting strap 108 is off of its associated roller can bring the lifting strap 108 into contact the adjacent non-rotating structure of the lifting device 100. Such contact can fray, tear, or otherwise wear the lifting strap.

Operating the lifting device 100 with the lifting strap 108 in a frayed, torn, or worn condition can substantially increase the potential for the lifting strap 108 to fail. The use of the roller assembly 10 can potentially reduce the potential for fraying, tearing, or premature wear of the lifting strap 108, and can thus extend the useful life of the lifting strap 108 and enhance the safety of the user of the lifting device 10.

The weight vector "W" normally acts in a direction substantially perpendicular to the centerlines C1 of the shaft member 12 when the power chair 101 is lifted and lowered while the transporting vehicle parked on a level surface, as discussed above.

Conversely, the weight vector "W" normally acts in a direction that is not substantially perpendicular to the centerline C1 when the transporting vehicle is parked on a non-level surface. The roller assembly 10 permits the centerline C2 of the roller member 14 to remain substantially perpendicular to the weight vector "W" under these conditions, and thereby allows the lifting strap 108 to remain substantially aligned with the weight vector "W" when the transporting vehicle is parked on a non-level surface. The roller assembly 10 can thus minimize the potential for tearing, fraying, or premature wear of the lifting strap 108 that could otherwise occur when the lifting device is operated under such conditions.

It is to be understood that even though numerous characteristics and advantages of the present invention have been set forth in the foregoing description, the disclosure is illustrative only and changes can be made in detail within the principles of the invention.

Figure 12:
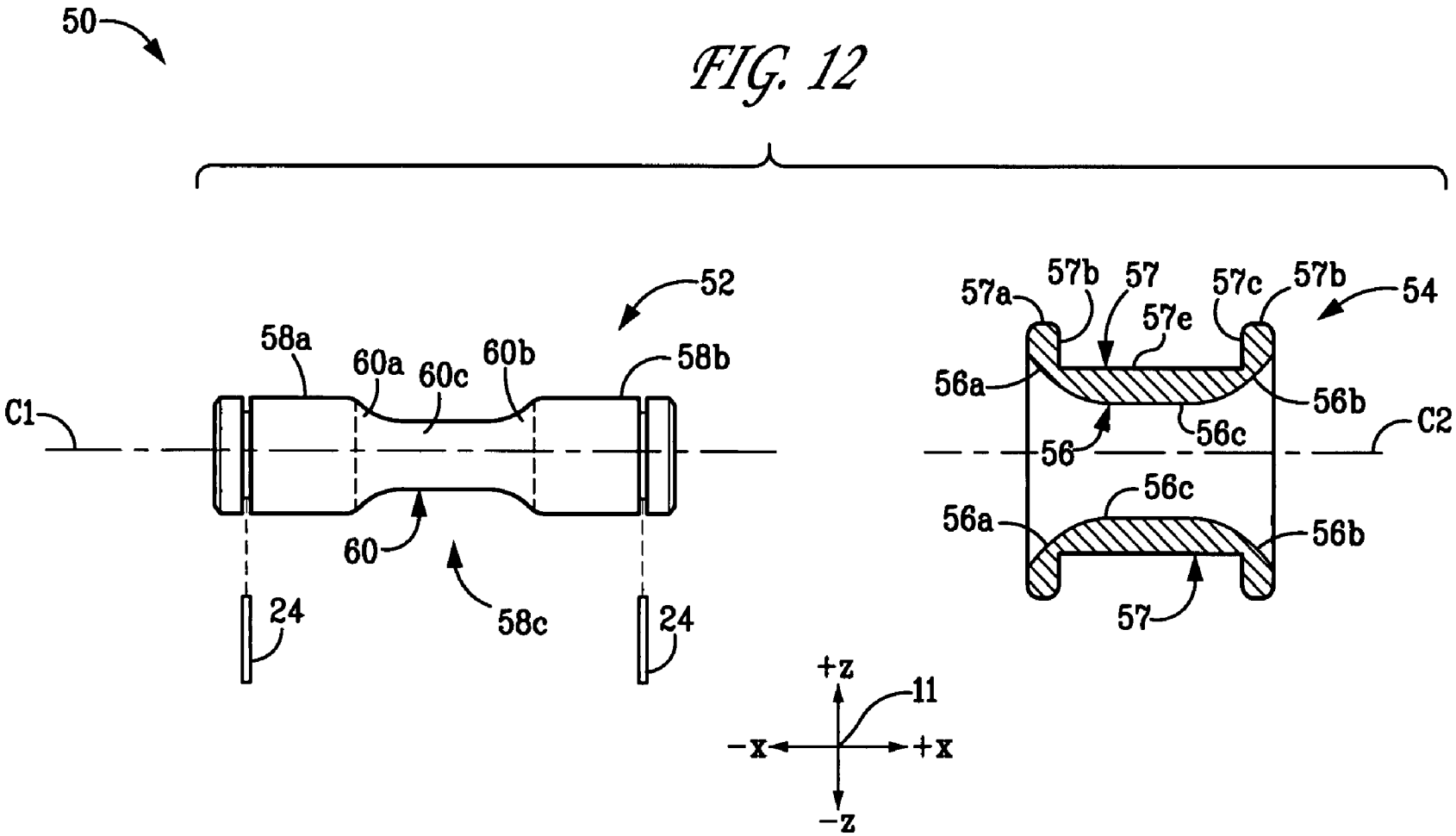
FIG. 12 is an exploded view of an alternative embodiment of the roller assembly shown in FIGS. 1–10, showing a roller member of the roller assembly in longitudinal cross section.
Figure 13:
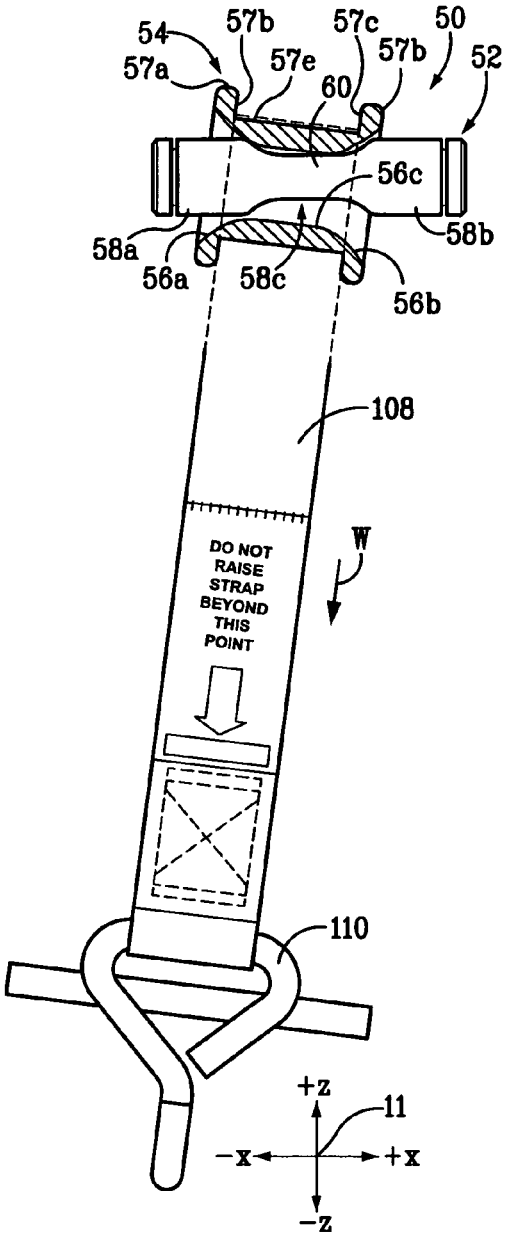
FIG. 13 is front view of the roller assembly shown in FIG. 12, and a lifting strap and a lifting hook of the lifting device shown in FIG. 1, showing the roller member in longitudinal cross section, with a weight vector acting on the lifting strap in a direction that is not substantially perpendicular to an axial centerline of a shaft member of the roller assembly.
Figure 14:
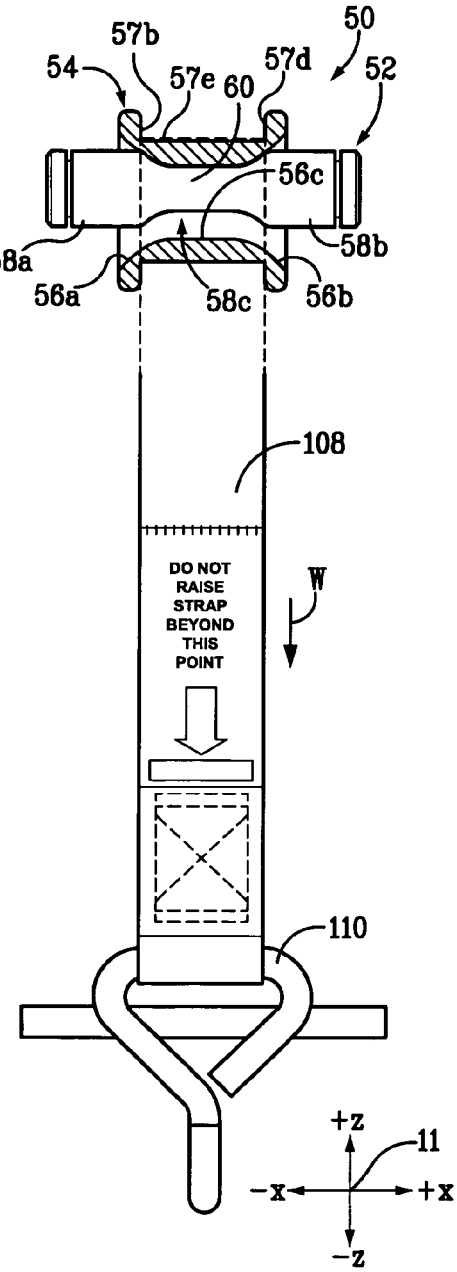
FIG. 14 is a front view of the roller assembly, the lifting strap, and the lifting hook shown in FIGS. 12 and 13, showing the roller member in longitudinal cross section, with the weight vector acting on the lifting strap in a direction that is substantially perpendicular to the axial centerline of the shaft member.

For example, FIGS. 12–14 depict an alternative embodiment of the roller assembly 10 in the form of a roller assembly 50 comprising a shaft member 52 and a roller member 54. The roller member 54 has a circumferentially-extending inner surface 56. The inner surface 56 includes a first and a second end portion 56*a*, 56*b*, and a middle portion 56*c* that adjoins the first and second end portions 56*a*, 56*b* (see FIG. 12). The middle portion 56*c* extends substantially parallel to an axial centerline "C2" of the roller member 54. (The middle portion 56*c* can be formed with a minimal radius of curvature with respect to the centerline C2, in the alternative.)

At least a portion of each end portion 56*a*, 56*b* of the inner surface 56 is curved so that the end portions 56*a*, 56*b* each extend away from the axial centerline C2 of the roller member 54. (The optimal radius of curvature for each of the end portions 56*a*, 56*b* is application dependent. Specific values for these parameters therefore are not presented herein.)

The roller member 54 also includes a circumferentially-extending outer surface 57. The outer surface 57 includes a first and a second end portion 57*a*, 57*b*, and a first and a second intermediate portion 57*c*, 57*d* that adjoin the respective first and second end portions 57*a*, 57*b*. The outer surface also includes a middle portion 57*e* that adjoins the first and second intermediate portions 57*c*, 57*d*.

The middle portion 57*e* preferably extends in a direction substantially parallel to the centerline C2 of the roller member 54. The first and second intermediate portions 57*c*, 57*d* preferably extend in a direction substantially perpendicular to the centerline C2. The lifting strap 108 is supported by the middle portion 57*e* (see FIGS. 13 and 14). The middle portion 57*e* preferably has a length ("x" dimension) that causes the lifting strap 108 to fit between the first and second intermediate portions 57*c*, 57*d* with minimal clearance. The end portions 57*a*, 57*b* are preferably rounded, as shown in FIG. 12–14.

The shaft member 52 includes a first end portion 58*a*, a second end portion 58*b*, and a middle portion 58*c* that adjoins the first and second end portions 58*a*, 58*b*. The first and second end portions 58*a*, 58*b* are substantially similar to the first and second end portions 16*a*, 16*b* of the shaft member 12 of the roller assembly 10. The middle portion 58*c* has a circumferentially-extending outer surface 60.

The outer surface 60 of the middle portion 58*c* substantially conforms to the inner surface 56 of the roller member 54. In particular, the outer surface 60 includes a first end portion 60*a*, a second end portion 60*b*, and a middle portion 60*c* that adjoins the first and second end portions 60*a*, 60*b*. The first and second end portions 60*a*, 60*b* each have a radius of curvature that substantially matches that of the respective first and second end portions 56*a*, 56*b* of the inner surface 56, as shown in FIG. 14. The middle portion 60*c* extends in a direction substantially parallel to an axial centerline "C1" of the shaft member 52, and has a length that substantially matches that of the middle portion 56*c* of the inner surface 56.

The roller assembly 50 operates in a manner substantially similar to that described above with respect the roller assembly 10. In particular, the complementary shapes of the inner surface 56 and the outer surface 60 cause the roller member 54 to remain substantially centered and level with respect to the shaft member 52 when the weight vector "W" acts in a direction substantially perpendicular to the axial centerlines C1 and C2 of the respective shaft member 52 and roller member 54 (see FIG. 14).

The noted geometry of the inner surface 56 and the outer surface 60 also facilitates relative movement between the inner surface 56 and the outer surface 60 in the axial ("x") and vertical ("z") directions when the weight vector "W" acts in a direction that is not substantially perpendicular to the centerlines C1 and C2 of the respective shaft member 52 and roller member 54. This feature permits the roller member 44 to move to a position in which the weight vector "W" is substantially perpendicular to the to the centerline C2 of the roller member 54 (see FIG. 13). The noted geometry of the inner surface 56 and the outer surface 60, it is believed, allows the roller member 54 to more easily move in the axial and vertical directions in relation to the shaft member 52, in comparison to the roller member 14 and the shaft member 12 of the roller assembly 10.

In addition, the above-noted geometry of the outer surface 57 of the roller member 54 can also facilitate movement of the roller member 54 in the axial and vertical directions. In particular, contact between the intermediate portions 57*c*, 57*d* and the lifting strap 108 can occur when the weight vector "W" acts in a direction substantially non-perpendicular to the centerline C2 of the roller member 54. This contact can urge the roller member 54 in the axial and vertical directions until the weight vector "W" acts in a direction substantially perpendicular to the centerline C2. Moreover, the intermediate portions 57*c*, 57*d* can help to retain the lifting strap 108 in a centered position on the roller member 57.

Figure 15:
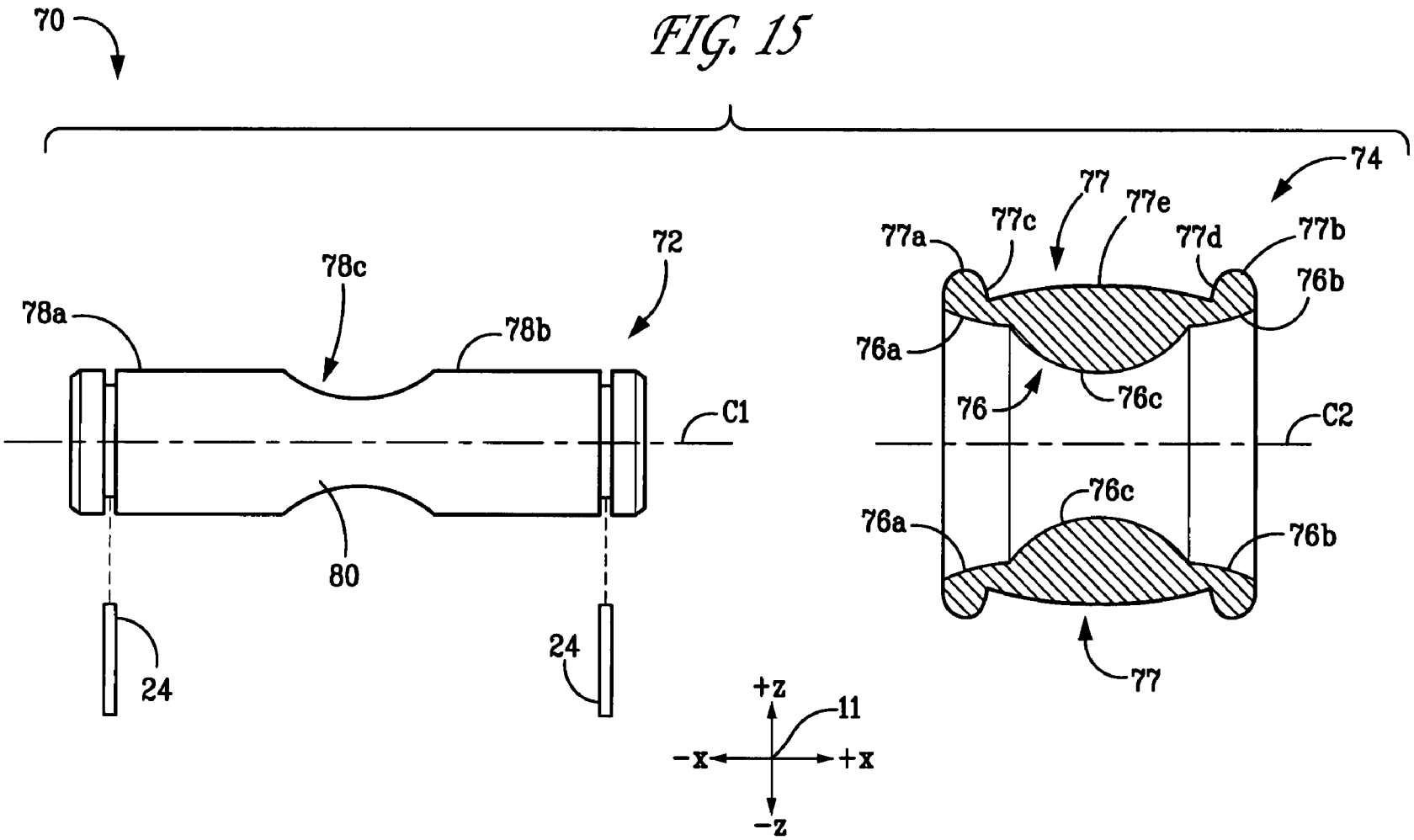
FIG. 15 is an exploded view of another alternative embodiment of the roller assembly shown in FIGS. 1–10, showing a roller member of the roller assembly in longitudinal cross section.
Figure 16:
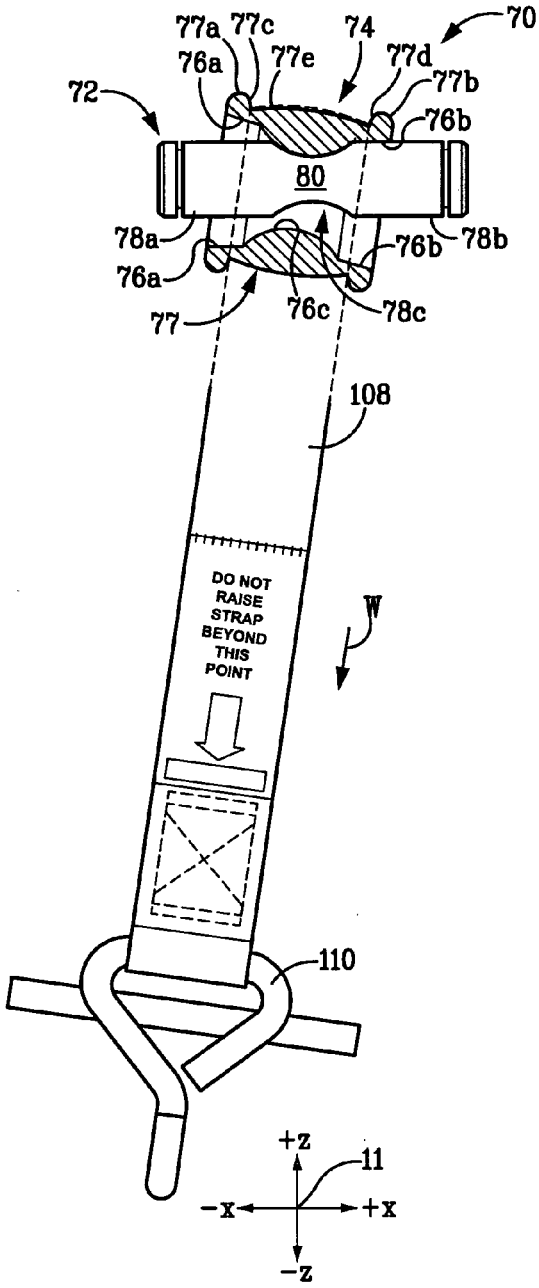
FIG. 16 is front view of the roller assembly shown in FIG. 15, and a lifting strap and a lifting hook of the lifting device shown in FIG. 1, showing the roller member in longitudinal cross section, with a weight vector acting on the lifting strap in a direction that is not substantially perpendicular to an axial centerline of a shaft member of the roller assembly.
Figure 17:
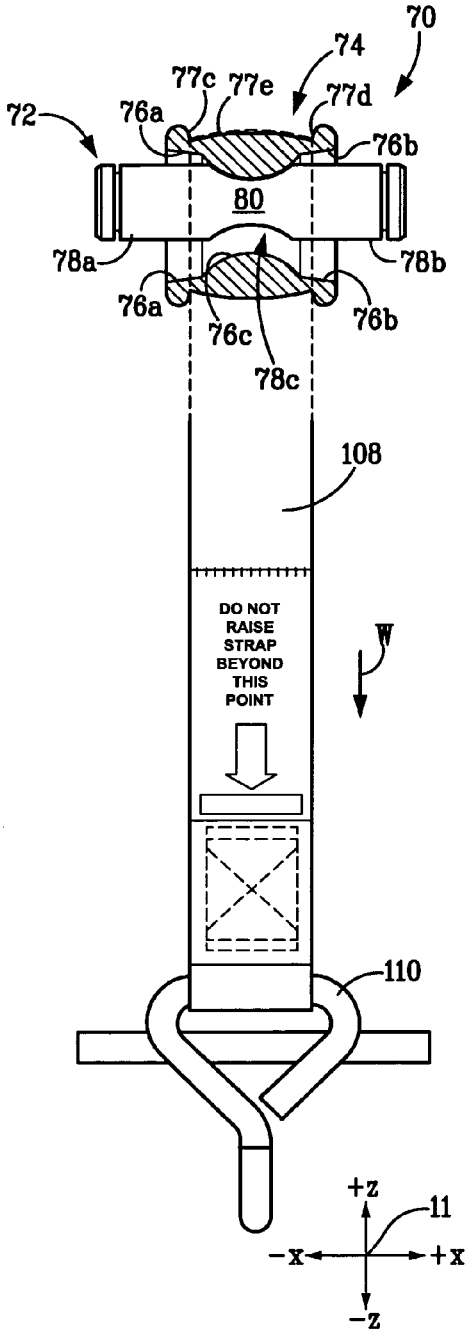
FIG. 17 is a front view of the roller assembly, the lifting strap, and the lifting hook shown in FIGS. 15 and 16, showing the roller member in longitudinal cross section, with the weight vector acting on the lifting strap in a direction that is substantially perpendicular to the axial centerline of the shaft member.

FIGS. 15–17 depict another alternative embodiment of the roller assembly 10 in the form of a roller assembly 70.

The roller assembly 70 comprises a shaft member 72 and a roller member 74. The roller member 74 has a circumferentially-extending inner surface 76. The inner surface 76 includes a first end portion 76*a*, a second end portion 76*b*, and a middle portion 76*c* that adjoins the first and second end portions 76*a*, 76*b* (see FIG. 15). The middle portion 76*c* has a substantially concave shape in relation to an axial centerline "C2" of the roller member 74. The first and second end portions 76*a*, 76*b* are substantially straight, and are angled away from the centerline C2 of the roller member 74.

The roller member 74 also includes a circumferentially-extending outer surface 77. The outer surface 77 includes a first and a second end portion 77*a*, 77*b*, and a first and a second intermediate portion 77*c*, 77*d* that adjoin the respective first and second end portions 77*a*, 77*b*. The outer surface also includes a middle portion 77*e* that adjoins the first and second intermediate portions 77*c*, 77*d*.

The middle portion 77*e* has a substantially convex shape in relation to the centerline C2 of the roller 74. The first and second intermediate portions 77*c*, 77*d* preferably extend in a direction substantially perpendicular to the centerline C2. The lifting strap 108 is supported by the middle portion 77*e* (see FIGS. 16 and 17).

The middle portion 77*e* preferably has a length that causes the lifting strap 108 to fit between the first and second intermediate portions 77*c*, 77*d* with minimal clearance. The end portions 77*a*, 77*b* are preferably rounded, as shown in FIGS. 15–17.

The shaft member 72 includes a first end portion 78*a*, a second end portion 78*b*, and an adjoining middle portion 78*c*. The middle portion 78*c* has a circumferentially-extending outer surface 80. The outer surface 80 has a concave shape that is substantially similar to that of the middle portion 76*c* of the inner surface 76.

The roller assembly 70 operates in a manner similar to that described above with respect the roller assembly 10. In particular, the complementary shapes of the inner surface 76 and the outer surface 80 cause the roller member 74 to remain substantially centered and level with respect to the shaft member 72 when the weight vector "W" acts in a direction substantially perpendicular to the centerlines C1 and C2 of the respective shaft member 72 and roller member 74.

Moreover, the upper portion of the roller assembly 70 can translate along an arc, in a manner similar to the upper portion of the roller member 14, when the weight vector "W" acts in a direction that is not substantially perpendicular to the centerlines C1, C2 of the respective shaft member 72 and roller member 74. The upper portion of the roller member 74 can translate in this manner until the roller member 74 approaches a position where the weight vector "W" is substantially perpendicular to the centerline C2 of the roller member 74 (see FIG. 16).

The first or the second end portions 76*a*, 76*b* of the inner surface 76 abut an outer surface of the respective first and second send portions 78*a*, 78*b* of the shaft member 72 when the upper portion of the roller member 74 has translated a predetermined distance, e.g., fifteen degrees, from is centered position (see FIG. 16). This contact acts to limit the degree of travel of the roller member 74.

In addition, the above-noted geometry of the outer surface 77 of the roller member 74 can also facilitate movement of the roller member 74 in the axial and vertical directions. In particular, contact between the intermediate portions 77*c*, 77*d* and the lifting strap 108 can occur when the weight vector "W" acts in a direction substantially non-perpendicular to the centerline C2 of the roller member 74. This contact can urge the roller member 74 in the axial and vertical directions until the weight vector "W" acts in a direction substantially perpendicular to the centerline C2. Moreover, the intermediate portions 77*c*, 77*d* can help to retain the lifting strap 108 in a centered position on the roller member 77. Also, the convex shape of the middle portion 77*e*, it is believed, can lessen of potential for the lifting strap 108 to separate from or otherwise become off-centered in relation to the roller member 77.

Figure 18:
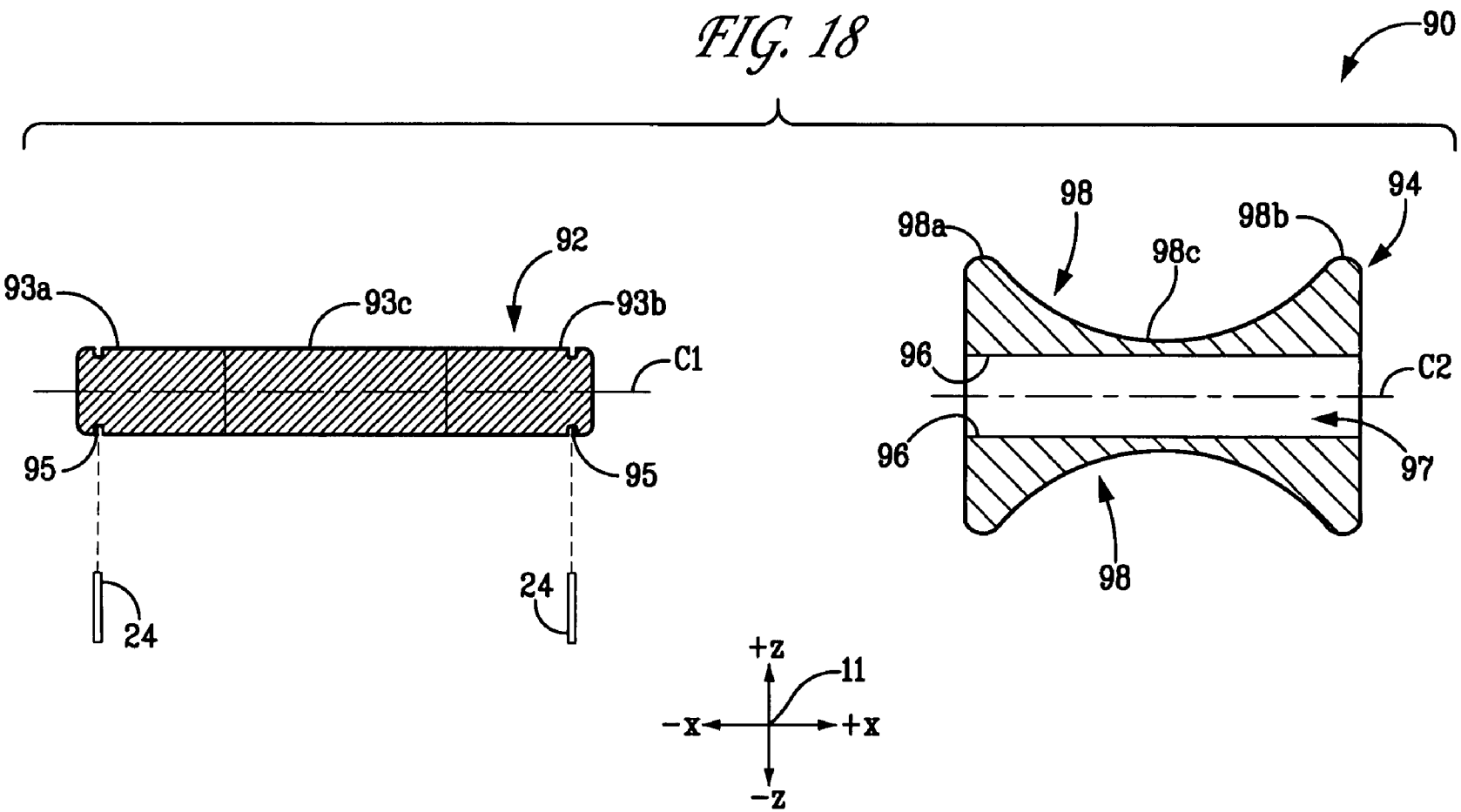
FIG. 18 is an exploded view of another alternative embodiment of the roller assembly shown in FIGS. 1–10, showing a roller member and a shaft member of the roller assembly in longitudinal cross section.
Figure 19:
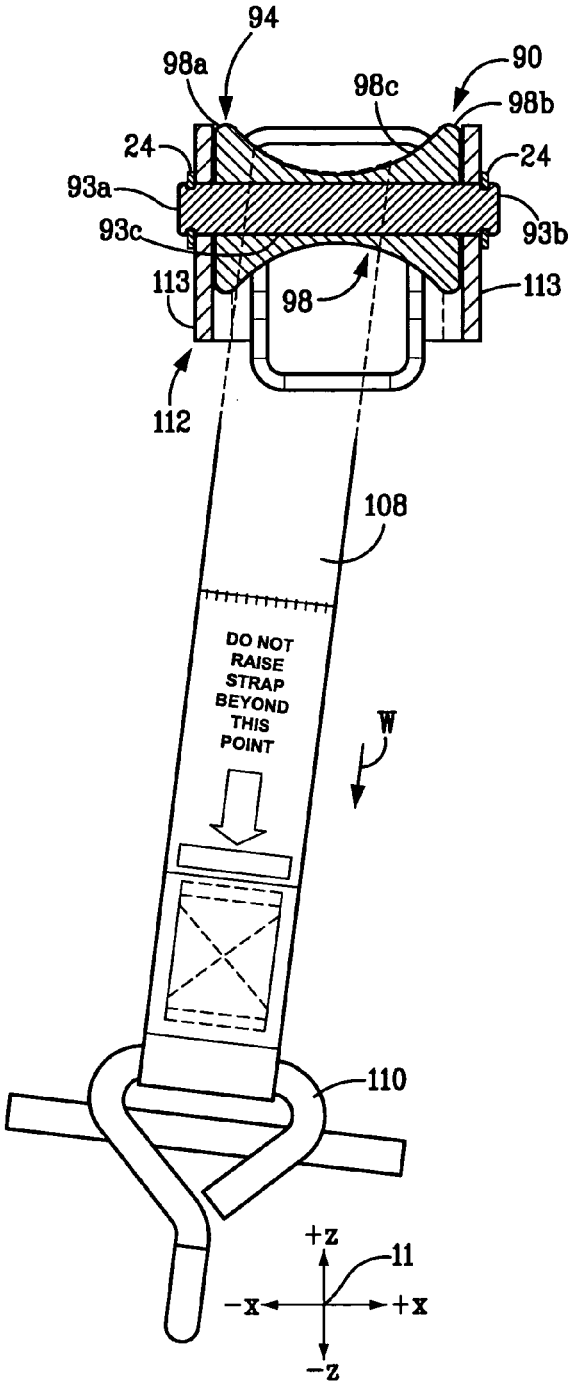
FIG. 19 is front view of the roller assembly shown in FIG. 18, and a lifting strap and a lifting hook of the lifting device shown in FIG. 1, showing the roller member and the shaft member in longitudinal cross section, with a weight vector acting on the lifting strap in a direction that is not substantially perpendicular to axial centerline of the shaft member.
Figure 20:
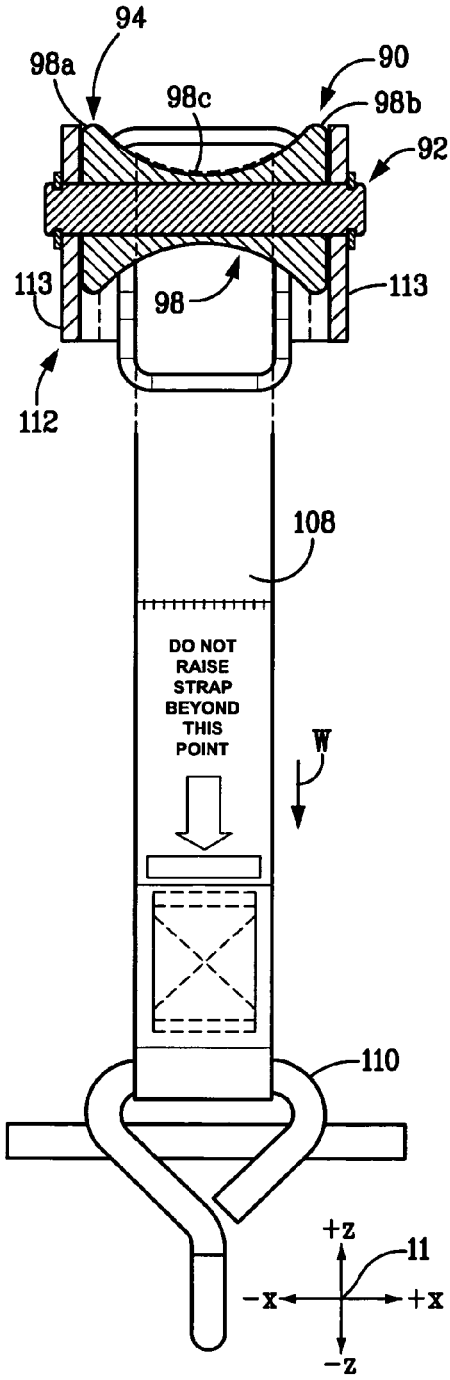
FIG. 20 is a front view of the roller assembly, the lifting strap, and the lifting hook shown in FIGS. 18 and 19, showing the roller member and the shaft member in longitudinal cross section, with the weight vector acting on the lifting strap in a direction that is substantially perpendicular to the axial centerline of the shaft member.
Figure 21:
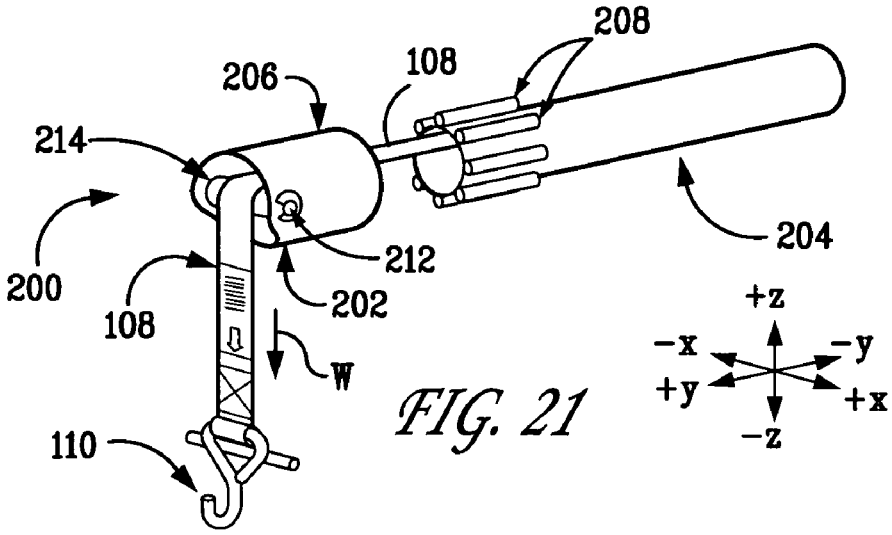
FIG. 21 is a perspective view of another alternative embodiment of the roller assembly shown in FIGS. 1–10, in a partially disassembled condition.
Figure 22:
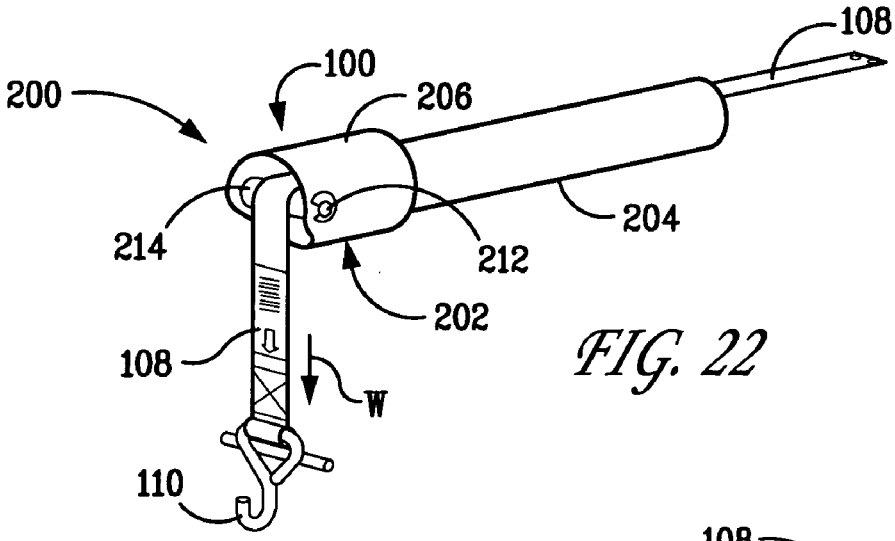
FIG. 22 is a perspective view of the roller assembly shown in FIG. 21, in an assembled condition.
Figure 23:
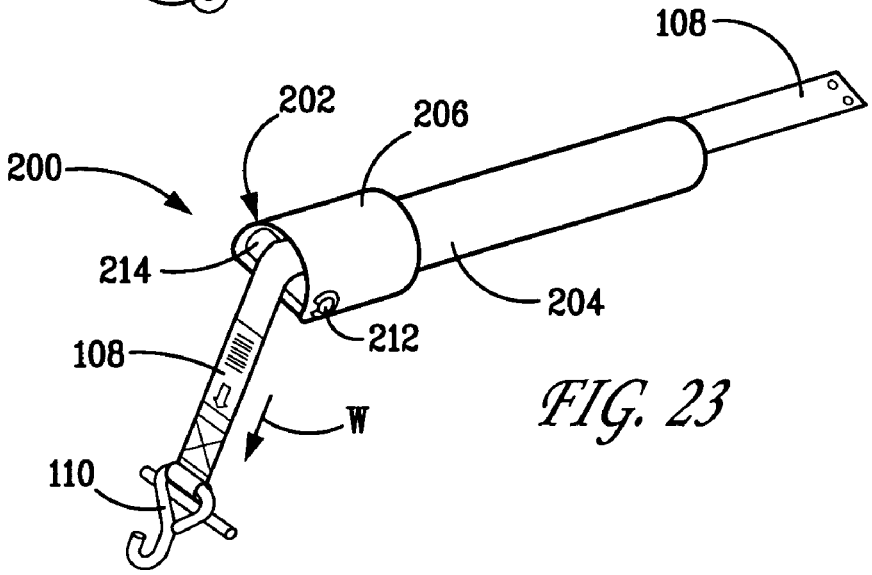
FIG. 23 is a perspective view of the roller assembly shown in FIGS. 21 and 22, with an outer ring of the roller assembly in a different orientation than to the orientation depicted in FIGS. 21 and 22.
Figure 24:
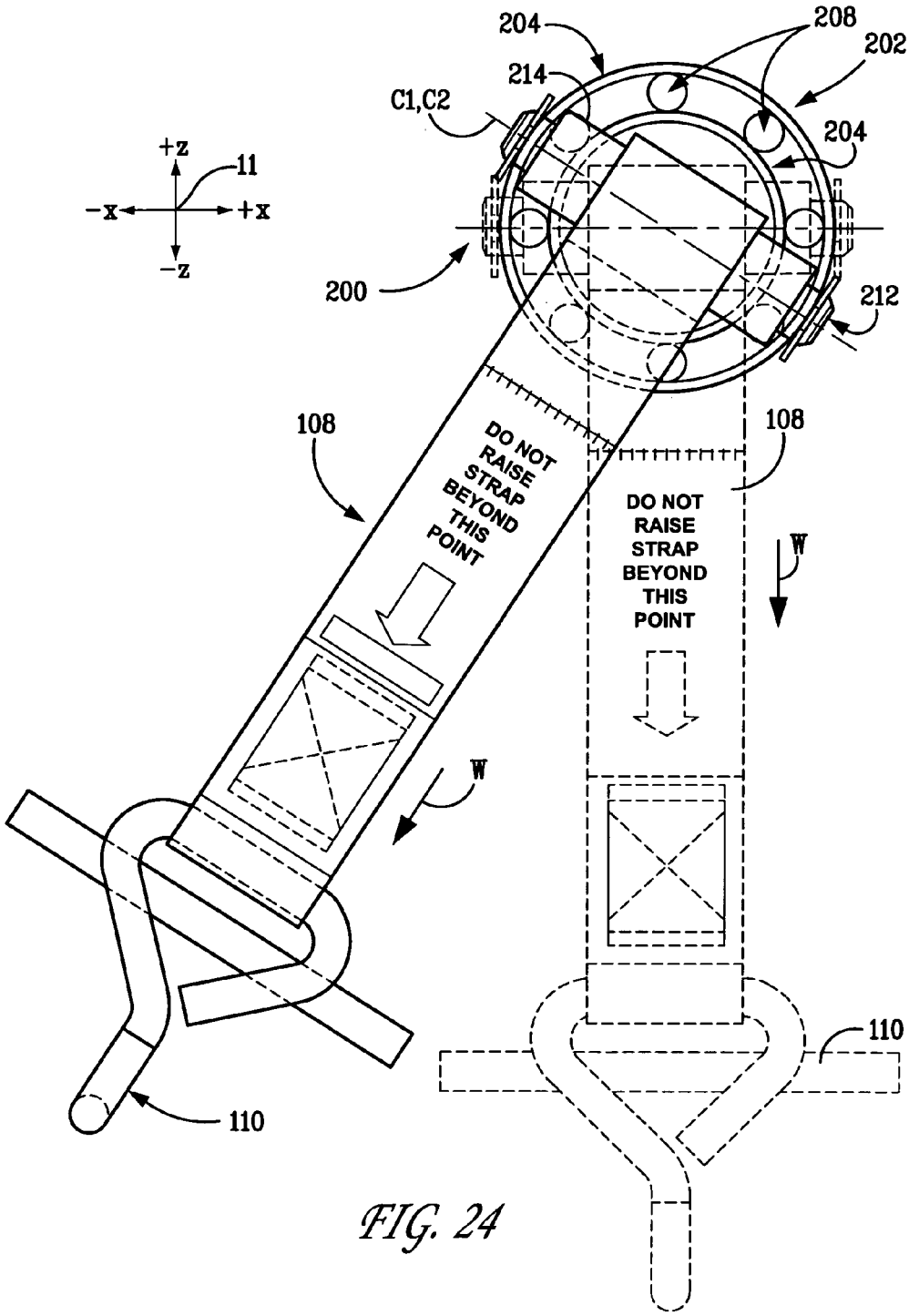
FIG. 24 is a front view of the roller assembly shown in FIGS. 21–23, depicting the outer ring in two different orientations.

FIGS. 18–20 depict another alternative embodiment of the roller assembly 10 in the form of a roller assembly 90. The roller assembly 90 comprises a shaft member 92 and a roller member 94. The shaft member 92 includes a first end portion 93*a*, a second end portion 93*b*, and a middle potion 93*c* that adjoins the first and second end portions 93*a*, 93*b*. The middle portion 93*c* is substantially uniform along its lengthwise ("x") direction. The first and second end portions each have a groove 95 formed therein to receive a respective one of the E-rings 24. The shaft member 92 is restrained from substantial movement in the axial, vertical, and lateral directions in a manner substantially similar to that described above with respect to the shaft member 12 of the roller assembly 10.

The roller member 94 has an internal surface 96 that defines a passage 97 within the roller member 94. The internal surface is 96 is substantially uniform along its lengthwise direction. The internal surface 96 preferably has a diameter that permits the shaft member 92 to fit within the passage 97 with minimal clearance between the internal surface 96 and an outer surface of the shaft member 92. In particular, the clearance between the internal surface 96 and the outer surface of the shaft member 92 is sufficient to permit the roller member 94 to rotate around an axial centerline "C1" of the shaft member 92, but is small enough to prevent substantial rotation or pivoting of the roller member 94 in relation to the shaft member 92.

The roller member 94 has a circumferentially-extending outer surface 98. The outer surface 98 preferably has a first end portion 98*a*, a second end portion 98*b*, and middle portion 98*c* that adjoins the first and second end portions 98*a*, 98*b*. The middle portion 98*c* has a substantially concave shape in relation to an axial centerline "C2" of the roller member 94. Preferably, the first and second end portions 98*a*, 98*b* each have a substantially rounded shape, as shown in FIGS. 18–20.

The concave shape of the middle portion 98*c*, it is believed, causes the lifting strap 108 to remain substantially centered on the roller member 94 when the weight vector "W" acts in a direction substantially perpendicular to the centerlines C1 and C2 of the respective shaft member 92 and roller member 94 (see FIG. 20). The lifting strap 108 can slide along the outer surface 96, in the axial ("x") and (vertical "z") directions, when the weight vector "W" acts in a direction that is not substantially perpendicular to the centerlines C1 and C2 of the respective shaft member 92 and roller member 94, until the lifting strap 108 extends in a direction substantially parallel to the weight vector "W" (see FIG. 19). Operating the lifting device 100 while the strap 108 is oriented in this manner, it is believed, can reduce the potential for the lifting strap 108 to fold, "bunch up," or separate from the roller member 94. This feature can be particularly valuable when, for example, the power chair 101 is lifted while the transporting vehicle is parked on a non-level surface.

FIGS. 21–24 depict another alternative embodiment of the roller assembly 10 in the form of a roller assembly 200.

The roller assembly 200 comprises a gimbal mechanism 202. The gimbal mechanism 202 comprises an inner cylinder 204, and an outer cylinder 206 positioned over a portion of the inner cylinder 204. The gimbal mechanism 202 also comprises a plurality of roller bearings 208 positioned between the outer cylinder 206 the inner cylinder 204. This arrangement permits the outer cylinder 206 to rotate in relation to the inner cylinder 204.

The roller assembly 200 also comprises a shaft member 212 mechanically coupled to the outer cylinder 206 so that the shaft member 212 is restrained from linear movement in relation to the outer cylinder 206. The roller assembly 200 further comprises a roller member 214 positioned around the shaft member 212 so that the roller member 214 can rotate in relation to a longitudinal centerline "C1" of the shaft member 212.

The above-noted arrangement permits the permits the outer ring 206 to rotate in relation to the inner ring 204 when the weight vector "W" is not substantially perpendicular to the centerlines C1, C2 of the respective shaft member 212 and roller member 214. The outer ring 206 can rotate until the centerlines C1, C2 of the respective shaft member 212 and roller member 214 are substantially perpendicular to the weight vector "W" (see FIG. 23).

What is claimed is:

1. A roller assembly for supporting a lifting strap of a lifting device for a personal-transportation vehicle, the roller assembly comprising:

a substantially straight shaft member for mounting on a lifting arm assembly of the lifting device; and a roller member mounted on the shaft member and having an outer surface for contacting the lifting strap and an inner surface that contacts an outer surface of the shaft member, at least a portion of the outer surface of the roller member having a substantially concave shape in relation to an axial centerline of the roller member, wherein the shaft member has a length that is substantially greater than a length of the roller member.

2. The roller assembly of claim 1, wherein the inner surface of the roller member defines a central passage for receiving the shaft member.

3. The roller assembly of claim 2, wherein a curvature of the at least a portion of the outer surface of the roller member is substantially equal to a curvature of at least a portion of the inner surface of the roller member.

4. The roller assembly of claim 2, wherein at least a portion of the outer surface of the shaft member has a substantially concave shape in relation to an axial centerline of the shaft member.

5. The roller assembly of claim 4, wherein a curvature of the at least a portion of the outer surface of the roller member is substantially equal to a curvature of at least a portion of the inner surface of the roller member.

6. The roller assembly of claim 4, wherein the roller member can rotate in relation to the shaft member in response to retraction and extension of the lifting strap into and out of the lifting arm assembly.

7. The roller assembly of claim 4, wherein the shaft member has a first and a second end portion and a middle portion, and the middle portion comprises the at least a portion of the outer surface of the shaft member.

8. The roller assembly of claim 7, wherein the first and second end portions each have a groove formed therein for receiving a respective clip, the clips restraining the shaft member from substantial axial movement.

9. The roller assembly of claim 2, wherein a minimum diameter of the inner surface is greater than a maximum diameter of the shaft member.

10. The roller assembly of claim 2, wherein the inner surface is substantially parallel to an axial centerline of the shaft member.

11. The roller assembly of claim 1, wherein the roller member remains substantially centered with respect to the shaft member when a weight vector acting through the lifting strap acts in a direction substantially perpendicular to an axial centerline of the shaft member and the axial centerline of the roller member.

12. A roller assembly for a lifting device for a personal-transportation vehicle, the roller assembly comprising:

a shaft member for mounting on a lifting arm assembly of the lifting device and having an outer surface; and a continuous roller member for supporting a lifting strap of the lifting device, the roller member having an inner surface defining a central passage for receiving the shaft and contacting the outer surface, the inner and outer surfaces having complementary profiles that permit a relative orientation of the roller member and the shaft member to change so that a weight vector acting through the lifting strap can remain substantially perpendicular to an axial centerline of the roller member.

13. A roller assembly for a lifting device for a personal-transportation vehicle, the roller assembly comprising:

a shaft member for mounting on a lifting arm assembly of the lifting device, the shaft member having an outer surface including a middle portion and an adjoining first and second end portion, the first and second end portions being curved so that the first and second end portions extend away from an axial centerline of the shaft member; and a continuous roller member mounted on the shaft member and having an inner surface defining a central passage for receiving the shaft member and contacting the outer surface, the inner surface including a middle portion and an adjoining first and second end portion, the first end portion of the inner surface having a radius of curvature substantially equal to a radius of curvature of the first end portion of the outer surface, and the second end portion of the inner surface having a radius of curvature substantially equal to a radius of curvature of the second end portion of the outer surface.

14. The roller assembly of claim 13, wherein the roller member remains substantially centered with respect to the shaft member when a weight vector acting through the lifting strap acts in a direction substantially perpendicular to the axial centerlines of the shaft member and the roller member.

15. The roller assembly of claim 13, wherein the middle portion of the inner surface extends substantially parallel to an axial centerline of the roller member, and the middle portion of the outer surface extends substantially parallel to an axial centerline of the shaft member.

16. The roller assembly of claim 13, wherein the roller member has an outer surface having a first and a second end portion, a first and a second intermediate portion that adjoin the respective first and second end portions and extend substantially perpendicular to the axial centerline of the roller member, and a middle portion that adjoins the first and second intermediate portions for contacting the lifting strap.

17. The roller assembly of claim 16, wherein the middle portion of the outer surface of the roller member extends in a direction substantially parallel to the axial centerline of the roller member.

18. The roller assembly of claim 16, wherein the middle portion of the outer surface of the roller member has a length substantially equal to a width of the lifting strap.

19. A roller assembly for supporting a lifting strap of a lifting device for a personal-transportation vehicle, the roller assembly comprising:

a shaft member for mounting on a lifting arm assembly of the lifting device; and a continuous roller member mounted on the shaft member and having an outer surface including a first and a second end portion, a first and a second intermediate portion that adjoin the respective first and second end portions and extend substantially perpendicular to an axial centerline of the roller member, and a middle portion that adjoins the first and second intermediate portions for contacting the lifting strap.

20. The roller assembly of claim 19, wherein the middle portion of the outer surface of the roller member is substantially convex in relation to the axial centerline of the roller member.

21. The roller assembly of claim 19, wherein the middle portion of the outer surface of the roller member has a length substantially equal to a width of the lifting strap.

22. A roller assembly for supporting a lifting device for a personal-transportation vehicle, the roller assembly comprising:

a shaft member for mounting on a lifting arm assembly of the lifting device, the shaft member having an outer surface, at least a portion of the outer surface of the shaft member having a substantially concave shape in relation to an axial centerline of the shaft member; and a roller member mounted on the shaft member and having an outer surface for contacting the lifting strap, at least a portion of the outer surface of the roller member having a substantially concave shape in relation to an axial centerline of the roller member.

23. A roller assembly for a lifting device for a personal-transportation vehicle, the roller assembly comprising:

a shaft member for mounting on a lifting arm assembly of the lifting device, the shaft member having an outer surface including a middle portion and an adjoining first and second end portion, the first and second end portions being curved so that the first and second end portions extend away from an axial centerline of the shaft member; and a roller member mounted on the shaft member and having an inner surface defining a central passage for receiving the shaft member and contacting the outer surface, the inner surface including a middle portion and an adjoining first and second end portion, the first end portion of the inner surface having a radius of curvature substantially equal to a radius of curvature of the first end portion of the outer surface, the second end portion of the inner surface having a radius of curvature substantially equal to a radius of curvature of the second end portion of the outer surface, the middle portion of the inner surface extending substantially parallel to an axial centerline of the roller member, and the middle portion of the outer surface extending substantially parallel to an axial centerline of the shaft member.

24. A roller assembly for supporting a lifting strap of a lifting device for a personal-transportation vehicle, the roller assembly comprising:

a shaft member for mounting on a lifting arm assembly of the lifting device; and a roller member mounted on the shaft member and having an outer surface including a first and a second end portion, a first and a second intermediate portion that adjoin the respective first and second end portions and extend substantially perpendicular to an axial centerline of the roller member, and a middle portion that adjoins the first and second intermediate portions for contacting the lifting strap, wherein the middle portion of the outer surface of the roller member is substantially convex in relation to the axial centerline of the roller member.

25. An assembly for a lifting device for a personal-transportation vehicle, the assembly comprising:

a strap;

an arm capable of being mounted on a column of the lifting device;

a shaft mounted on the arm; and a roller rotatably mounted on the shaft, wherein the roller has an outer surface that contacts the lifting strap and at least a portion of the outer surface is curved so that the at least a portion of the outer surface extends away from an axis of rotation of the roller.

26. The assembly of claim 25, wherein the roller is a continuous roller.

27. The assembly of claim 25, wherein the shaft has a length that is substantially greater than a length of the roller.

28. The assembly of claim 25, wherein the shaft and the roller support the lifting strap.

29. The assembly of claim 25, further comprising a spool rotatably mounted on the arm, where the strap is attached to the spool so that rotation of the spool causes the strap to retract into and extend from the arm.

30. The assembly of claim 25, where the lifting arm supports the strap by way of the shaft and the roller.

* * * * *